US010986939B2

(12) United States Patent
Szpak

(10) Patent No.: US 10,986,939 B2
(45) **Date of Patent: *Apr. 27, 2021**

(54) PRODUCT PUSHER ASSEMBLY

(71) Applicant: Fasteners for Retail, Inc., Twinsburg, OH (US)

(72) Inventor: Gerald Matthew Szpak, Brecksville, OH (US)

(73) Assignee: Fasteners for Retail, Inc., Twinsburg, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/885,817

(22) Filed: May 28, 2020

(65) Prior Publication Data

US 2020/0315372 A1 Oct. 8, 2020

Related U.S. Application Data

(63) Continuation of application No. 16/153,331, filed on Oct. 5, 2018, now Pat. No. 10,667,629.

(51) Int. Cl.

| | |
|---|---|
| ***A47F 1/12*** | (2006.01) |
| ***A47F 5/00*** | (2006.01) |
| ***A47B 57/58*** | (2006.01) |

(52) U.S. Cl.

CPC ..... *A47F 1/126* (2013.01); *A47B 57/583* (2013.01); *A47B 57/585* (2013.01); *A47F 5/005* (2013.01); *A47F 5/0068* (2013.01)

(58) Field of Classification Search

CPC .. A47F 1/126; A47F 5/005; A47F 1/00; A47F 1/04; A47F 1/12; A47F 1/125; A47F 3/02; A47F 7/28; A47F 7/283; A47F 2003/021; A47F 3/08; A47F 5/0025; A47F 5/0068; A47F 5/16; A47G 19/32; A47B 57/58; A47B 57/583; A47B 57/585; A47B 57/586; A47B 57/588; A47B 65/00; A47B 65/15

USPC ..... 211/59.3, 119.003, 184; 312/35; 108/61, 108/71

See application file for complete search history.

(56) References Cited

U.S. PATENT DOCUMENTS 4,712,694 A * 12/1987 Breslow ..... A47F 5/005 108/61
5,123,546 A * 6/1992 Crum ..... A47F 1/126 206/556

(Continued)

FOREIGN PATENT DOCUMENTS

| | | |
|---|---|---|
| EP | 0986980 A1 | 3/2000 |
| JP | 2014-18503 A | 2/2014 |

OTHER PUBLICATIONS

Non-Final Office Action dated Oct. 22, 2019, by the U.S. Patent and Trademark Office relating to U.S. Appl. No. 16/153,331.

*Primary Examiner* — Jennifer E. Novosad
(74) *Attorney, Agent, or Firm* — Honigman LLP

(57) ABSTRACT

A product pusher assembly includes a front rail, a base member, and a pusher. The front rail includes a first lower surface and a second lower surface spaced from the first lower surface. The base member is adjustably coupled to the front rail. The base member includes a first upper surface configured to engage the first lower surface. The pusher is coupled to the base member. The pusher includes a second upper surface configured to engage the second lower surface.

16 Claims, 7 Drawing Sheets

(56) References Cited

U.S. PATENT DOCUMENTS 5,190,186 A * 3/1993 Yablans ..... A47F 1/126 221/124
5,562,217 A * 10/1996 Salveson ..... A47F 1/126 211/175
6,041,720 A * 3/2000 Hardy ..... A47B 96/02 108/60
6,105,791 A * 8/2000 Chaison ..... A47F 1/126 211/59.3
6,142,317 A 11/2000 Merl
6,227,385 B1 * 5/2001 Nickerson ..... A47F 1/126 108/61
6,299,004 B1 * 10/2001 Thalenfeld ..... A47F 1/12 211/184
6,533,131 B2 * 3/2003 Bada ..... A47B 57/583 211/184
6,772,888 B2 * 8/2004 Burke ..... A47F 1/126 211/51
6,796,445 B2 * 9/2004 Cyrluk ..... G09F 3/204 211/183
6,964,235 B2 11/2005 Hardy
7,063,217 B2 * 6/2006 Burke ..... A47F 1/126 211/119.003
7,201,281 B1 * 4/2007 Welker ..... A47F 1/126 211/59.3
7,395,938 B2 * 7/2008 Merit ..... A47F 5/005 211/184
7,641,057 B2 * 1/2010 Mueller ..... A47F 1/126 211/59.3
8,016,128 B2 * 9/2011 Valiulis ..... A47F 1/126 211/59.3
8,069,994 B2 * 12/2011 Barkdoll ..... A47F 1/126 211/59.3
8,177,076 B2 * 5/2012 Rataiczak, III ..... A47F 1/126 211/59.3
8,496,126 B2 * 7/2013 Mueller ..... A47F 1/126 211/59.3
8,561,817 B1 * 10/2013 Allen ..... A47F 1/126 211/59.3
9,320,367 B2 4/2016 Chambers
9,538,860 B2 * 1/2017 Brej ..... A47F 1/126
9,629,483 B2 * 4/2017 Walker ..... A47F 5/005
9,955,802 B2 * 5/2018 Bird ..... A47B 57/58
10,667,629 B2 * 6/2020 Szpak ..... A47B 57/585
2004/0245197 A1 * 12/2004 McElvaney ..... A47F 1/126 211/184
2007/0090068 A1 * 4/2007 Hardy ..... A47F 1/126 211/59.3
2007/0158281 A1 * 7/2007 Hardy ..... A47F 1/04 211/59.3
2008/0156752 A1 * 7/2008 Bryson ..... A47F 1/126 211/59.3
2010/0089847 A1 * 4/2010 Rataiczak, III ..... A47F 1/126 211/59.3
2010/0230369 A1 * 9/2010 Weshler ..... A47F 5/005 211/59.3
2011/0100941 A1 * 5/2011 Luberto ..... A47F 1/126 211/134
2011/0139736 A1 * 6/2011 Hardy ..... A47F 1/126 211/59.3
2011/0174750 A1 * 7/2011 Poulokefalos ..... A47F 5/005 211/59.3
2012/0006773 A1 * 1/2012 Mueller ..... A47F 1/126 211/59.3
2013/0062295 A1 * 3/2013 Bird ..... A47F 1/126 211/59.3
2013/0270204 A1 * 10/2013 Bird ..... A47F 1/125 211/59.3
2014/0138330 A1 * 5/2014 Hardy ..... A47B 57/588 211/59.3
2015/0041418 A1 * 2/2015 Grubbs ..... A47F 1/126 211/59.3
2018/0140113 A1 5/2018 Hardy et al.
2018/0242756 A1 * 8/2018 Berg ..... A47F 1/125

* cited by examiner

PRODUCT PUSHER ASSEMBLY

CROSS REFERENCE TO RELATED APPLICATIONS

This U.S. patent application is a continuation of, and claims priority under 35 U.S.C. § 120 from, U.S. patent application Ser. No. 16/153,331, filed on Oct. 5, 2018, the disclosure of which is considered part of the disclosure of this application and is hereby incorporated by reference in its entirety.

FIELD

The present disclosure relates generally to product shelf displays.

BACKGROUND

This section provides background information related to the present disclosure and is not necessarily prior art.

Products in a commercial setting, such as a store, may be displayed in a variety of ways. For example, a series of shelving units may be used to stock and display the products. The products may be arranged in columns and rows, with products of the same type arranged in a column behind one another and products of different types arranged in a row next to each other. When the first product in a column is selected and removed from the shelf, the second product in the column may be moved to the first product's position to occupy the void left by the removal of the first product.

SUMMARY

This section provides a general summary of the disclosure, and is not a comprehensive disclosure of its full scope or all of its features.

One aspect of the disclosure provides a product pusher assembly. The product pusher assembly includes a front rail, a base member, and a pusher. The front rail includes a first lower surface and a second lower surface spaced from the first lower surface. The base member is adjustably coupled to the front rail. The base member includes a first upper surface configured to engage the first lower surface. The pusher is coupled to the base member. The pusher includes a second upper surface configured to engage the second lower surface.

Implementations of the disclosure may include one or more of the following optional features. In some implementations, the engagement of the second lower surface and the second upper surface inhibits rotation of the base member relative to the front rail.

In some implementations, the front rail includes a channel defined by a first wall and a second wall opposite the first wall. The base member may be partially disposed in the channel. The first wall may include a ledge disposed on a surface of the first wall facing the channel. The ledge may have the first lower surface. The second wall may include a lip disposed on a surface of the second wall facing away from the channel. The lip may have the second lower surface.

In some implementations, the base member includes a first catch disposed in the channel. The first catch may have the first upper surface.

In some implementations, the pusher includes a second catch disposed outside of the channel. The second catch may include the second upper surface.

In some implementations, the base member includes a slot configured to receive the second wall of the front rail.

In some implementations, the product pusher assembly includes a biasing member coupled to the base member and engaged with the pusher. The biasing member may bias the pusher toward the front rail. The biasing member may be a flat coil spring.

In some implementations, the base member includes a slot. The pusher may be slidably engaged with the slot.

In some implementations, the front rail includes a plurality of teeth. The base member may include a tooth projection configured to engage the plurality of teeth.

Another aspect of the disclosure provides a product pusher assembly. The product pusher assembly includes a front rail, a base member, and a pusher. The front rail may have a channel defined by a first wall and a second wall opposite the first wall. The first wall may have a ledge disposed on a surface of the first wall facing the channel, and the ledge may have a first lower surface. The second wall may have a lip disposed on a surface of the second wall facing away from the channel, and the lip may have a second lower surface. The base member may have a first catch disposed in the channel, and the first catch may have a first upper surface configured to engage the first lower surface. The pusher may be coupled to the base member and may have a second catch disposed outside of the channel. The second catch may have a second upper surface configured to engage the second lower surface.

This aspect may include one or more of the following optional features. In some implementations, the engagement of the second lower surface and the second upper surface inhibits rotation of the base member relative to the front rail.

In some implementations, the base member includes a slot configured to receive the second wall of the front rail.

In some implementations, the product pusher assembly includes a biasing member coupled to the base member and engaged with the pusher. The biasing member may bias the pusher toward the front rail. The biasing member may be a flat coil spring. The biasing member may include an aperture, and the base member may include a stem configured to engage the aperture.

In some implementations, the base member includes a slot. The pusher may be slidably engaged with the slot.

In some implementations, the channel extends in a first direction. The pusher may be slidable along a second direction substantially perpendicular to the first direction.

In some implementations, the front rail includes a plurality of teeth. The base member may include a tooth projection configured to engage the plurality of teeth.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected configurations and not all possible implementations, and are not intended to limit the scope of the present disclosure.

Corresponding reference numerals indicate corresponding parts throughout the drawings.

DETAILED DESCRIPTION

Figure 1:
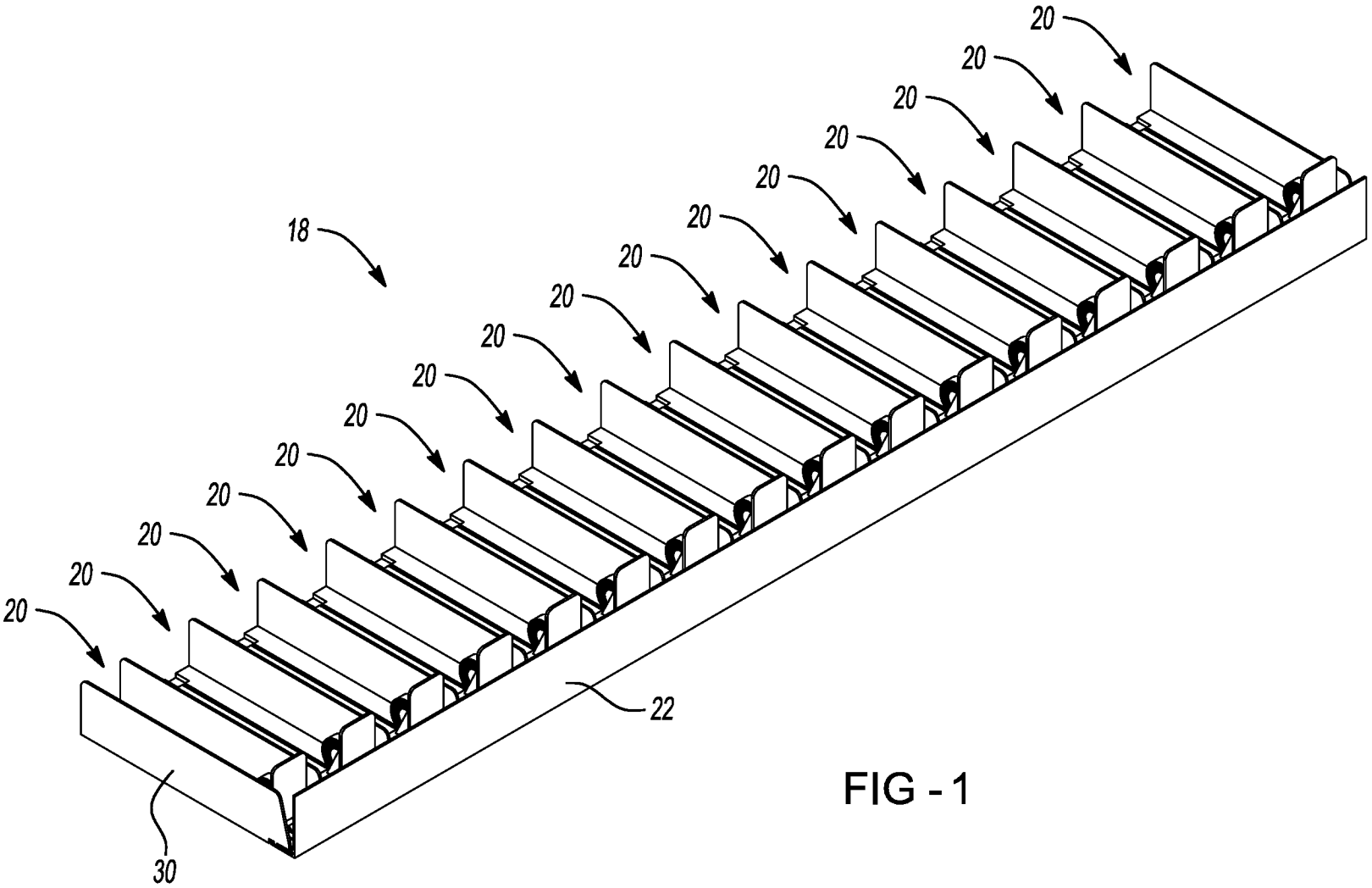
FIG. 1 is a perspective view of a plurality of exemplary product pusher assemblies in accordance with the principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

Figure 2:
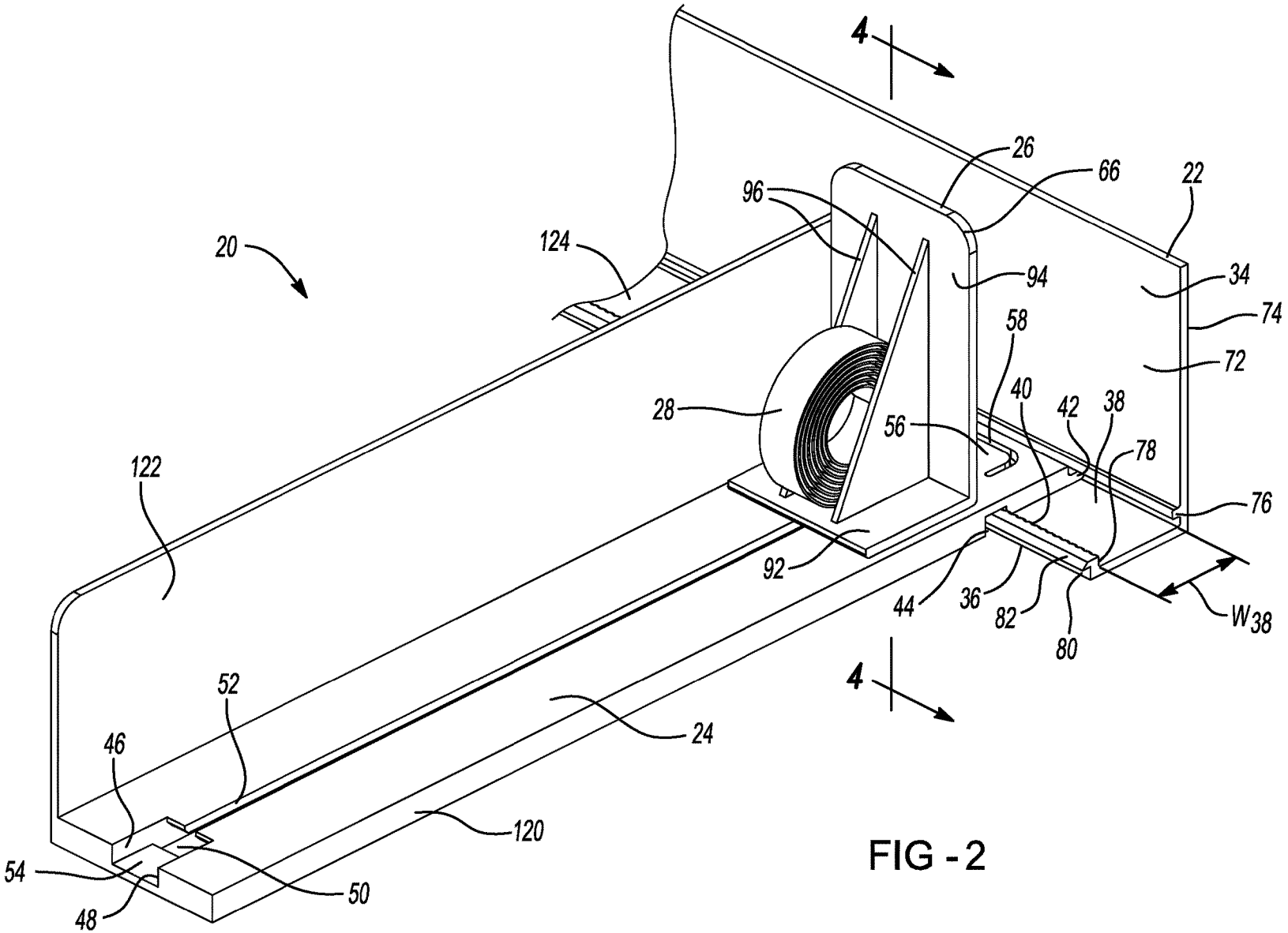
FIG. 2 is a perspective view of one of the product pusher assemblies of FIG. 1.
Figure 4A:
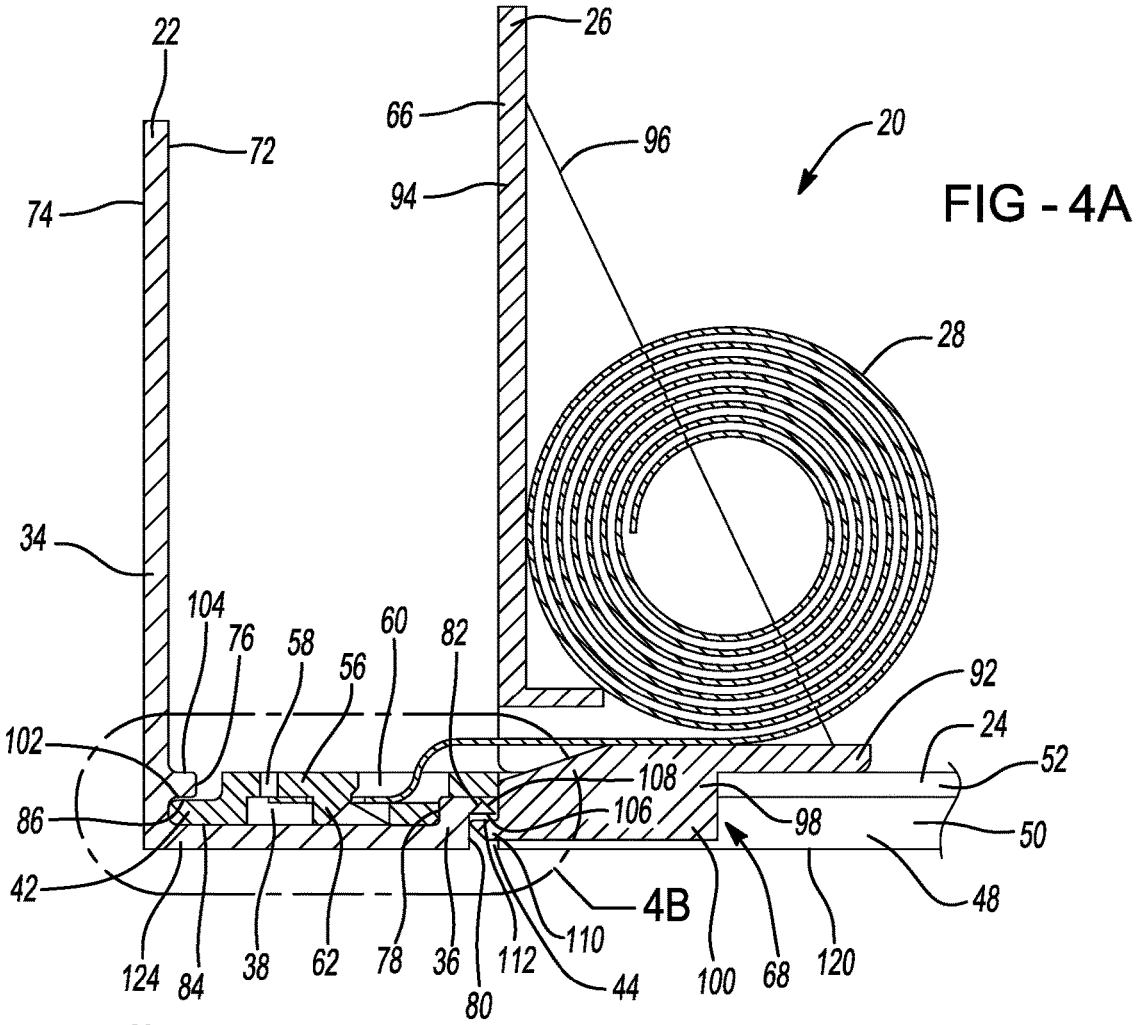
FIG. 4A is a cross-sectional view of one of the product pusher assemblies of FIGS. 1 and 2.
Figure 4B:
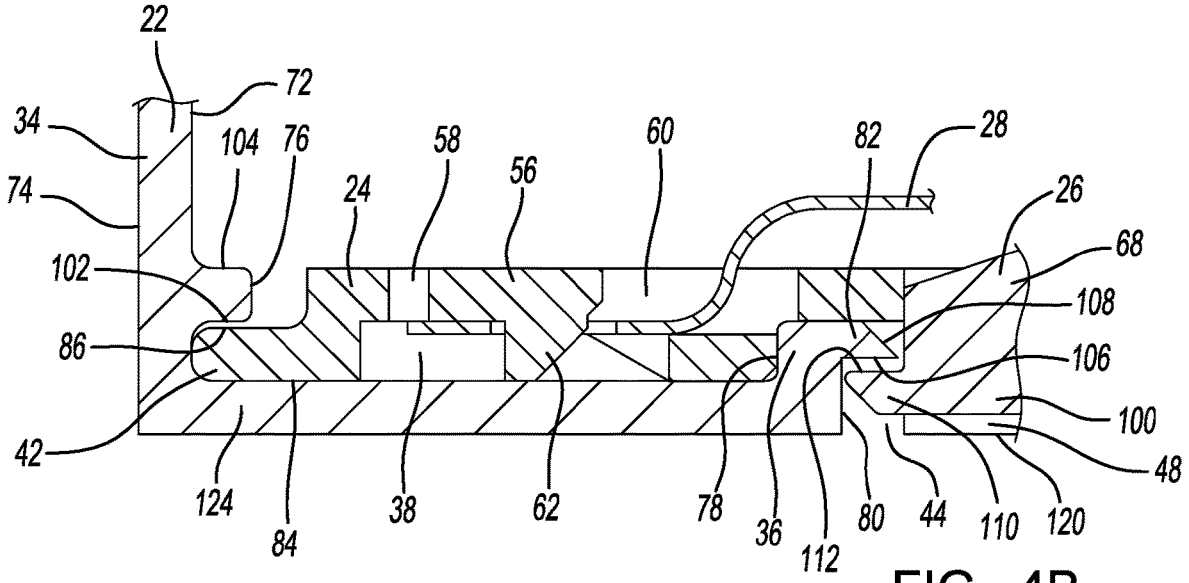
FIG. 4B is an enlarged view of a portion of the cross-sectional view of FIG. 4A.

With reference to FIG. 1, a shelf assembly 18 is generally shown. The shelf assembly 18 may be disposed on a shelf (not shown) or other suitable supporting surface, and may include a plurality of product pusher assemblies 20. The product pusher assemblies 20 may each include a front rail 22, a base member 24, and a pusher 26, as shown in FIG. 2. With reference to FIGS. 4A and 4B, the front rail 22 includes a first lower surface 102 and a second lower surface 106 spaced from the first lower surface 102. The base member 24 is adjustably coupled to the front rail 22. The base member 24 includes a first upper surface 86 configured to engage the first lower surface 102. The pusher 26 is coupled to the base member 24. The pusher 26 includes a second upper surface 112 configured to engage the second lower surface 106.

With reference to FIGS. 1 and 2, the shelf assembly 18 may further include a side member 30. Each base member 24 may include a base 120 and a side wall 122. Each pusher 26 may further include an upper wall 94. The side member 30, the bases 120, the side walls 122, and the upper walls 94 may receive a plurality of products (not shown) arranged in rows extending along the front rail 22 and columns extending along each base member 24. The shelf assembly 18 may be arranged such that the front rail 22 generally faces a location where a prospective consumer would be situated. As will be described below, when a consumer, or any other suitable operator, removes one of the products (i.e., the first product in one of the columns), the product pusher assembly 20 may push another of the products (i.e., the second product in the column) toward the front rail 22 to occupy a void left by the removal of the first product. While the shelf assembly 18 is generated illustrated as having sixteen product pusher assemblies 20, as shown in FIG. 1, it should be understood that the shelf assembly 18 may include any suitable number of product pusher assemblies 20.

With continued reference to FIGS. 1 and 2, the shelf assembly 18 may include one, singular front rail 22 configured to receive the plurality of base members 24. As another example, there may be any suitable number of front rails 22. The front rail 22 may include a first wall 34 and a second wall 36 spaced from and opposite the first wall 34. The first wall 34 and the second wall 36 may define a channel 38 having a width W38. The front rail 22 may include a base 124 extending from the first wall 34 to the second wall 36. The base 124 may be positioned generally perpendicular to the first wall 34 and the second wall 36.

With reference to FIGS. 2, 4A, and 4B, the first wall 34 may include an interior surface 72 and an exterior surface 74 opposite the interior surface 72. For example, the interior surface 72 may face the channel 38 and the exterior surface 74 may face away from the channel 38. The first wall 34 may include a ledge 76 disposed on, and extending from, the interior surface 72. For example, the ledge 76 may extend at least partially into the channel 38. The ledge 76 may include the first lower surface 102 and an upper surface 104 opposite the first lower surface 102. The ledge 76 is shown as having a generally rectangular cross-section, however, it should be understood that the ledge 76 may have any suitable cross-section, such as, for example, a triangular cross-section, an elliptical cross-section, a hook-shaped cross-section, etc.

The first wall 34 and the ledge 76 may be formed of a unitary construction, i.e., formed as a single body. As another example, the first wall 34 and the ledge 76 may be formed separately, and the ledge 76 may be affixed to the first wall 34 in any suitable manner, such as, for example, via mechanical fasteners, welding, adhesive, etc. The first wall 34 may have any suitable level of transparency, for example, the first wall 34 may be completely transparent, partially transparent, partially opaque, or completely opaque.

The second wall 36 may include an interior surface 78 and an exterior surface 80 opposite the interior surface 78. For example, the interior surface 78 may face the channel 38 and the exterior surface 80 may face away from the channel 38. The second wall 36 may include a lip 82 disposed on, and extending from, the exterior surface 80. For example, the lip 82 may extend away from the channel 38. The lip 82 may include the second lower surface 106 and an upper surface 108 opposite the second lower surface 106. The lip 82 is shown as having a generally triangular cross-section, however, it should be understood that the ledge 76 may have any suitable cross-section, such as, for example, a rectangular cross-section, an elliptical cross-section, a hook-shaped cross-section, etc. The second wall 36 and the lip 82 may be formed of a unitary construction, i.e., formed as a single body. As another example, the second wall 36 and the lip 82 may be formed separately, and the lip 82 may be affixed to the second wall 36 in any suitable manner, such as, for example, via mechanical fasteners, welding, adhesive, etc.

Figure 5:
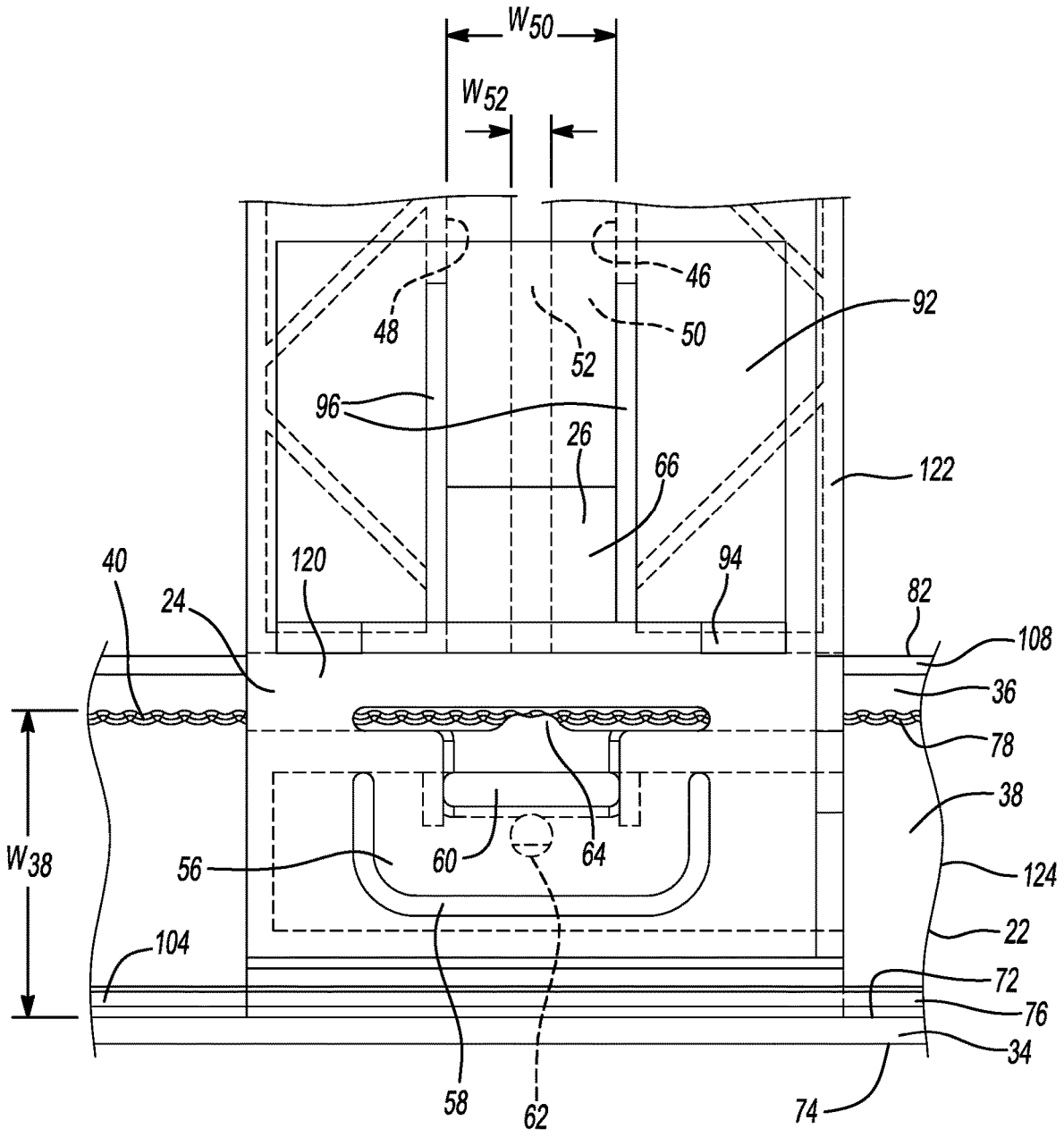
FIG. 5 is a top view of a portion of one of the product pusher assemblies of FIGS. 1, 2, and 4A.
Figure 6:
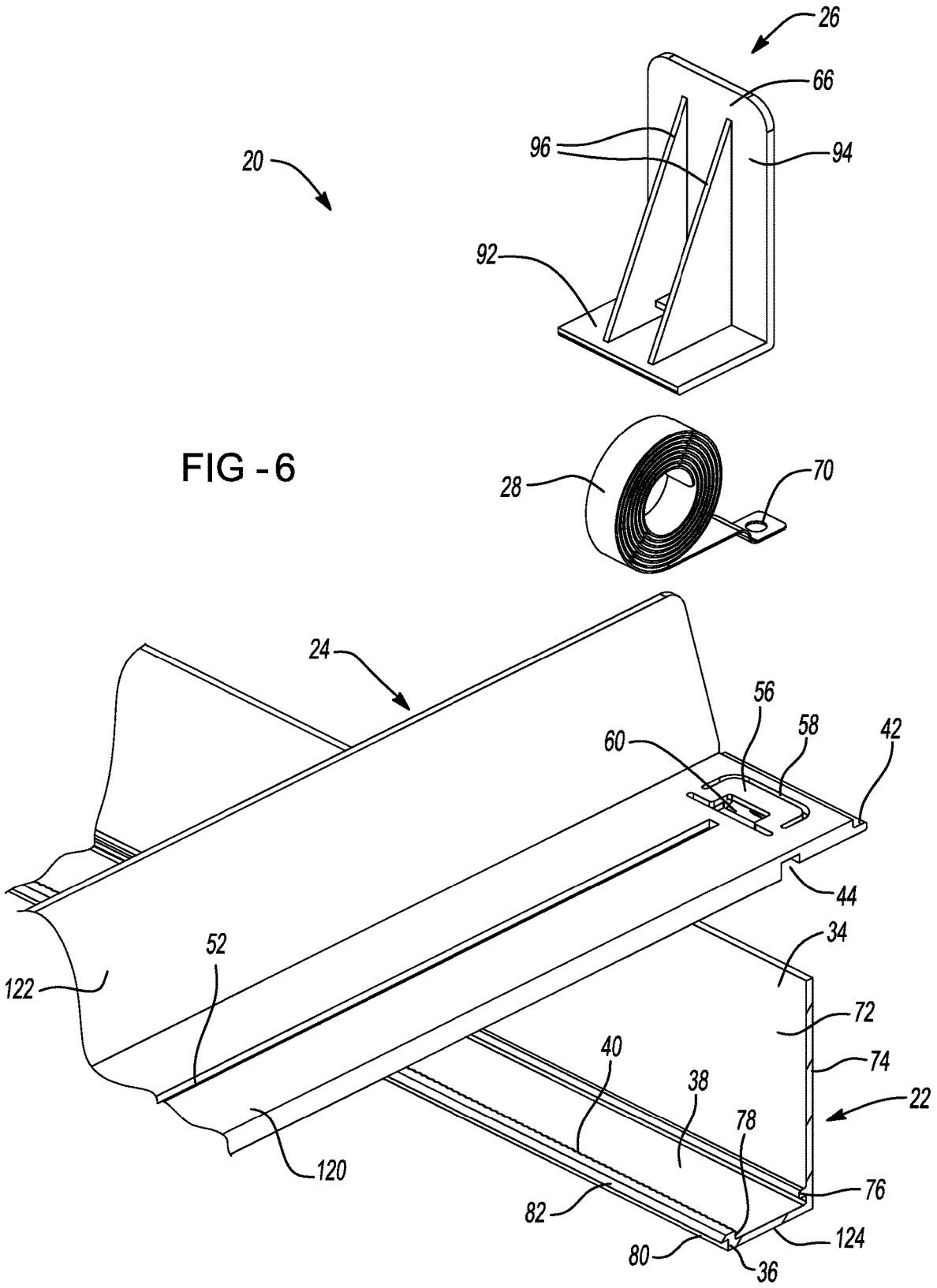
FIG. 6 is an exploded view of one of the product pusher assemblies of FIGS. 1, 2, and 4A.
Figure 7:
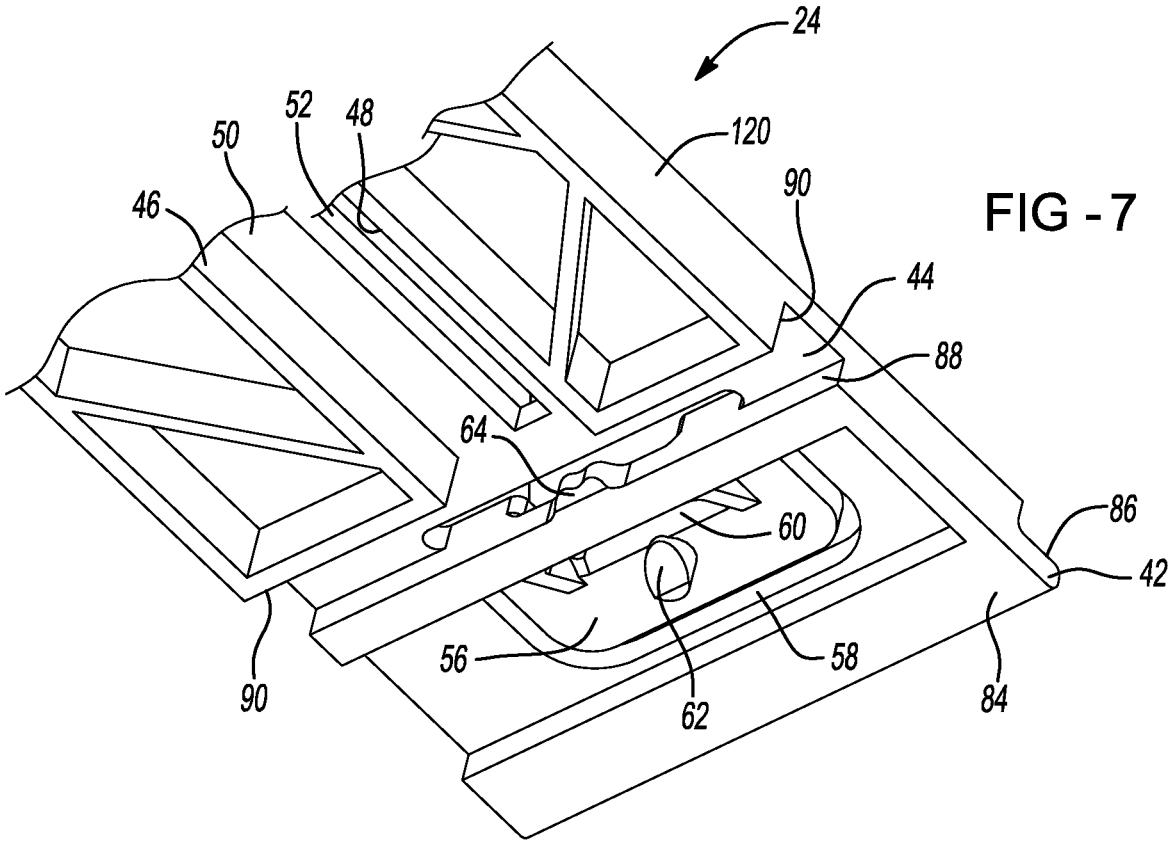
FIG. 7 is a perspective view of an exemplary base member of one of the product pusher assemblies of FIGS. 1-6.

With reference to FIGS. 2, 5, and 6, the second wall 36 may include a plurality of teeth 40 disposed on the interior surface 78. The second wall 36 and the teeth 40 may be formed of a unitary construction, i.e., formed as a single body. As another example, the second wall 36 and the teeth 40 may be formed separately, and the teeth 40 may be affixed to the second wall 36 in any suitable manner, such as, for example, via mechanical fasteners, welding, adhesive, etc. The front rail 22 may be formed of any suitable material, such as, for example, a plastic, a metal, a composite, etc.

With reference to FIGS. 2-7, the base member 24 may be adjustably coupled to the front rail 22. For example, the base member 24 may be partially disposed in the channel 38. That is, a portion of the base member 24 may be disposed in the channel 38. The front rail 22 may extend in a first direction and the base member 24 may extend in a second direction generally perpendicular to the first direction. The base 120 and the side wall 122 may be situated generally perpendicular to each other. A plurality of products (not shown) may be placed in a column extending along the base 120 and the side wall 122 between the pusher 26 and the front rail 22.

Figure 3:
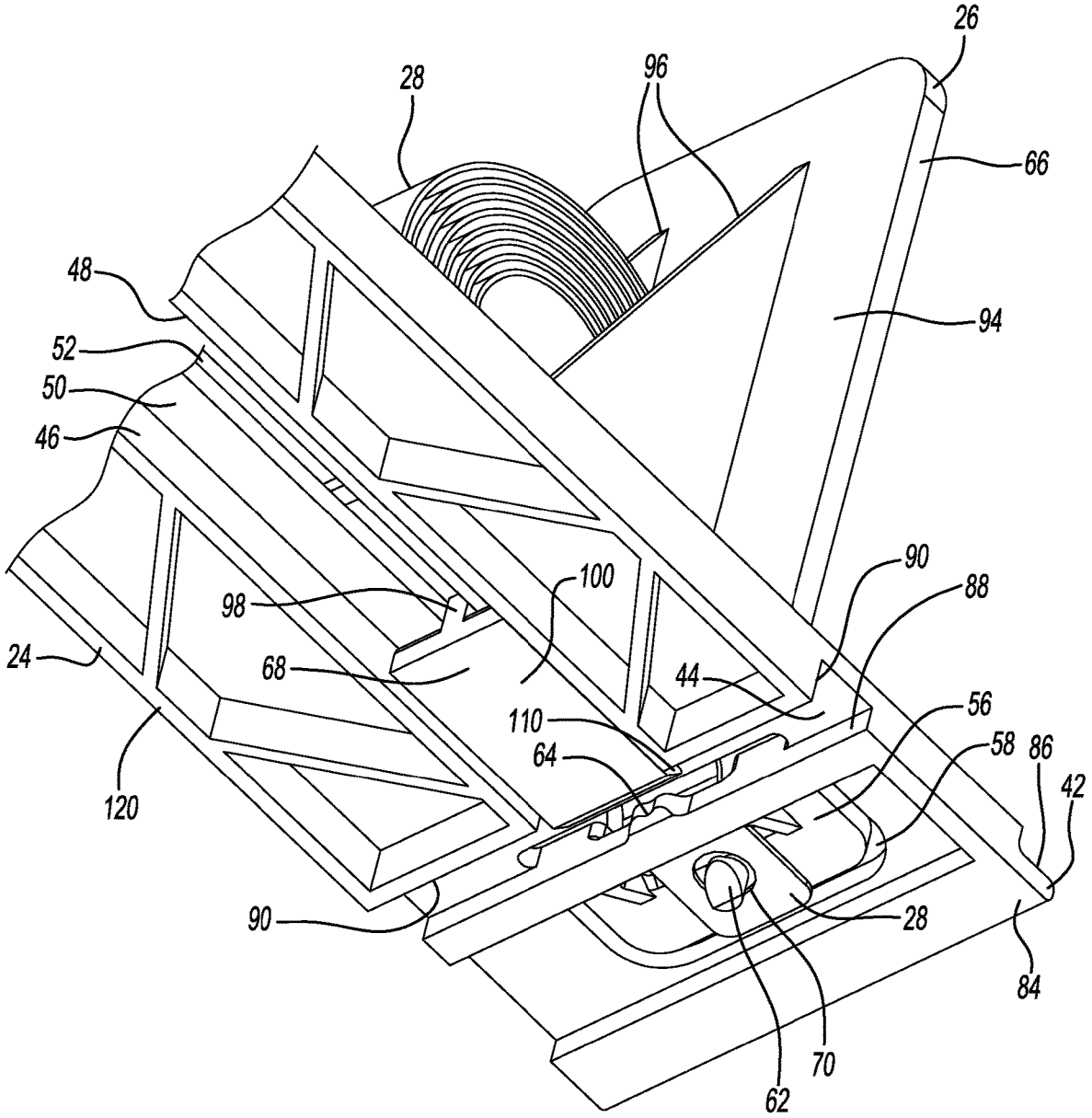
FIG. 3 is a perspective view of a portion of one of the product pusher assemblies of FIGS. 1 and 2.

With reference to FIGS. 3-4B, the base member 24 may include a first catch 42 disposed in the channel 38. The first catch 42 may include the first upper surface 86 and a lower surface 84 opposite the first upper surface 86. The lower surface 84 may abut the base 124 of the front rail 22. The first upper surface 86 is configured to engage the first lower surface 102 of the ledge 76. That is, the first upper surface 86 may selectively abut the first lower surface 102. The engagement of the first upper surface 86 and the first lower surface 102 may constrain or limit rotation of the base member 24 relative to the front rail 22. The first catch 42 is shown as having a generally rectangular cross-section, however, it should be understood that the first catch 42 may have any suitable cross-section, such as, for example, a triangular cross-section, an elliptical cross-section, a hook-shaped cross-section, etc. The base member 24 and the first catch 42 may be formed of a unitary construction, i.e., formed as a single body. As another example, the base member 24 and the first catch 42 may be formed separately, and the first catch 42 may be affixed to the base member 24 in any suitable manner, such as, for example, via mechanical fasteners, welding, adhesive, etc.

With reference to FIG. 3, the base member 24 may include a wall slot 44 configured to receive the second wall 36 and the lip 82 of the front rail 22. That is, the wall slot 44 may include a front surface 88 and a back surface 90 spaced from the front surface 88, and a distance from the front surface 88 to the back surface 90 may be greater than a width of the second wall 36 including the lip 82. In this regard, the second wall 36 and the lip 82 may be disposed in the wall slot 44 in the assembled configuration.

The base member 24 may include a tooth projection 64 disposed on the front surface 88 of the wall slot 44. For example, the tooth projection 64 may be disposed in the wall slot 44. The tooth projection 64 may be configured to engage the plurality of teeth 40 of the front rail 22. For example, adjacent teeth 40 may define a gap therebetween, and the tooth projection 64 may engage one of the gaps. As another example, the tooth projection 64 may include a gap, and the gap may receive one of the teeth 40.

The base member 24 may include a flex member 56 defined by a first aperture 58 (e.g., through-hole). The first aperture 58 may be generally U-shaped or shaped in any suitable manner. The flex member 56 and the first aperture 58 may be arranged in a manner to allow the flex member 56 to move relative to a remaining portion of the base 120 (i.e., move into the first aperture 58).

With reference to FIGS. 3-4B, and 7, the base member 24 may include a stem 62 disposed in the channel 38. The stem 62 may extend from the flex member 56 toward the base 124. The stem 62 may abut the base 124. The stem 62 may have any suitable size and shape. The base member 24 and the stem 62 may be formed of a unitary construction, i.e., formed as a single body. As another example, the base member 24 and the stem 62 may be formed separately, and the stem 62 may be affixed to the base member 24 in any suitable manner, such as, for example, via mechanical fasteners, welding, adhesive, etc.

With reference to FIGS. 2, 3, 5, and 7, the base member 24 may include a first body surface 46 and a second body surface 48 spaced from and opposite the first body surface 46. The first body surface 46 and the second body surface 48 may define a body channel 50 having a width $W_{50}$. The base member 24 may include a pusher slot 52 having a width $W_{52}$. The width $W_{50}$ of the body channel 50 may be greater than the width $W_{52}$ of the pusher slot 52. The base member 24 may include an entry slot 54. The entry slot 54 may have a width greater than or equal to the width $W_{50}$ of the body channel 50. The base member 24 may also include a second aperture 60 (e.g., through-hole) adjacent to the flex member 56. The base member 24 may be formed of any suitable material, such as, for example, a plastic, a metal, a composite, etc.

With reference to FIGS. 2-6, and 8, the pusher 26 may include an upper portion 66, a lower portion 68, and an aperture 118. The upper portion 66 may include an upper base 92, the upper wall 94, and alignment members 96. The upper base 92 may abut the base 120 of the base member 24, and the upper wall 94 may extend generally perpendicular to the base 120 and the side wall 122. The alignment members 96 may extend from the upper base 92 to the upper wall 94. The aperture 118 may be disposed between each of the alignment members 96.

The lower portion 68 may include a main body 100 having a width $W_{100}$, a top surface 114, and side surfaces 116. The entry slot 54 may receive the main body 100. One of the side surfaces 116 may face the first body surface 46 and the other of the side surfaces 116 may face the second body surface 48. The body channel 50 may receive the main body 100. For example, the width $W_{50}$ of the body channel 50 may be greater than the width $W_{100}$ of the main body 100. The top surface 114 may face an underside of the base 120. The lower portion 68 may include an elongate member 98 disposed on the top surface of the main body 100. The elongate member 98 may be configured to engage the pusher slot 52. That is, the width $W_{52}$ of the pusher slot 52 may be greater than a width of the elongate member 98. The pusher 26 may be slidably engaged with the pusher slot 52. For example, the elongate member 98 may slide along the pusher slot 52 and the upper base 92 may slide along the base 120. For example, the channel 38 may extend in a first direction and the pusher 26 may be slidable along a second direction substantially perpendicular to the first direction.

Figure 8:
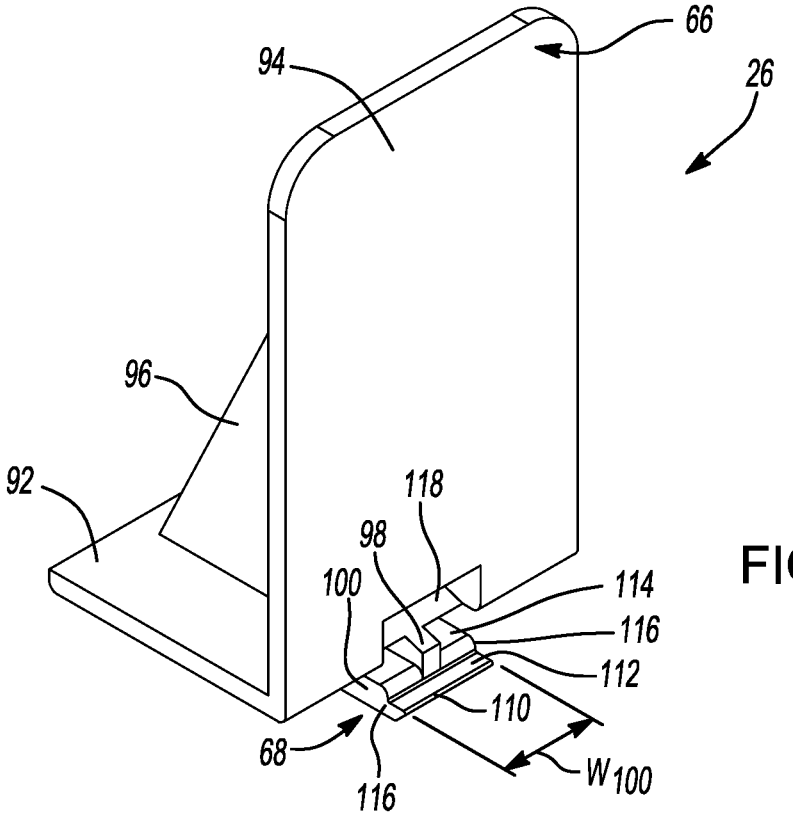
FIG. 8 is a perspective view of an exemplary pusher of one of the product pusher assemblies of FIGS. 1-6.

With reference to FIGS. 4A, 4B, and 8, the lower portion 68 may include a second catch 110 disposed outside of the channel 38 in the assembled configuration. For example, the second catch 110 may be disposed in the wall slot 44. The second catch 110 may extend from one of the side surfaces 116 to the other of the side surfaces 116. The second catch 110 may include the second upper surface 112 configured to engage the second lower surface 106 of the lip 82. That is, the second upper surface 112 may selectively abut the second lower surface 106. The engagement of the second upper surface 112 and the second lower surface 106 may constrain rotation of the base member 24 relative to the front rail 22. In some implementations, engagement of the second upper surface 112 and the second lower surface 106 may prevent rotation of the base member 24 relative to the front rail 22. The second catch 110 is shown as having a generally triangular cross-section, however, it should be understood that the second catch 110 may have any suitable cross-section, such as, for example, a rectangular cross-section, an elliptical cross-section, a hook-shaped cross-section, etc. The pusher 26 and the second catch 110 may be formed of a unitary construction, i.e., formed as a single body. As another example, the pusher 26 and the second catch 110 may be formed separately, and the second catch 110 may be affixed to the pusher 26 in any suitable manner, such as, for example, via mechanical fasteners, welding, adhesive, etc.

The upper portion 66 and the lower portion 68 may be formed of a unitary construction, i.e., formed as a single body. As another example, the upper portion 66 and the lower portion 68 may be formed separately, and the lower portion 68 may be affixed to the upper portion 66 in any suitable manner, such as, for example, via mechanical fasteners, welding, adhesive, etc. The pusher 26 may be formed of any suitable material, such as, for example, a plastic, a metal, a composite, etc.

With reference to FIGS. 2-4B, and 6, the product pusher assembly 20 may include a biasing member 28 coupled to the base member 24 and engaged with the pusher 26. For example, the biasing member 28 may include an aperture 70 located at a distal end. The biasing member 28 may extend through the aperture 118 of the pusher 26, through the second aperture 58 of the base member 24, and the aperture 70 may receive the stem 62 of the base member 24, e.g., the stem 62 may engage the base member 24. The stem 62 may inhibit transverse motion of the biasing member 28. The biasing member 28 may be disposed between the alignment members 96, and the alignment members 96 may inhibit transverse motion of the biasing member 28.

The biasing member 28 may bias the pusher 26 toward the front rail 22. For example, a plurality of products (not shown) may be situated on the base member 24 between the pusher 26 and the front rail 22. The biasing member 28 may exert a force on the pusher 26 toward the front rail 22, and the plurality of products may exert an opposing force on the pusher 26. The biasing member 28 may be any suitable biasing member, such as, for example, a flat coil spring, a pulley, a member exhibiting elastic properties, etc. The biasing member 28 may be formed of any suitable material, such as, for example, a plastic, a metal, a composite, a rubber, etc.

In light of the foregoing structural description, the operation of the product pusher assembly 20 will now be described. The shelf assembly 18 may be placed on a shelf in a commercial setting, such as a store, with the front rail 22 facing toward a location where a prospective consumer would be situated. The pusher 26 may be slid away from the front rail 22, and a plurality of products (not shown) may be placed in a column on the base member 24 between the pusher 26 and the front rail 22. The biasing member 28 may exert a force on the pusher 26 toward the front rail 22 and the plurality of products may exert an opposing force on the pusher 26. This may be accomplished by the front rail 22 exerting a force on a first product in the column, the force being transmitted through each of the products, including the last product in the column (i.e., the product adjacent the pusher 26), and to the pusher 26. Upon removal of the first product in the column, there would no longer be a product abutting the front rail 22, thus, the front rail 22 would not be exerting a force on the column of products. Because the biasing member 28 biases the pusher 26 toward the front rail 22, the pusher 26 may push the products and the products may slide toward the front rail 22 until the new first product in the column abuts the front rail 22 and the front rail 22 exerts a force on the new first product. Upon removal of all of the products from the pusher assembly 20, the second catch 110 may be disposed within the wall slot 44 such that the second upper surface 112 faces the second lower surface 106. Engagement of the second upper surface 112 with the second lower surface 106 can prevent movement of the pusher 26 relative to the front rail 22, and thus prevent movement of the base member 24 relative to the front rail 22.

The shelf assembly 18 may be modified to accommodate products of different sizes (e.g., widths). For example, the product pusher assembly 20 may be moved to modify a distance between adjacent side walls 122. A force may be exerted on the tooth projection 64 (e.g., via contact with one of the teeth 40), and the force may be transmitted to the flex member 56. In response, the flex member 56 may flex toward the first aperture 58. The first aperture 58 may allow the flex member 56 to move toward the first wall 34 of the front rail 22. As a result, the tooth projection 64 may be allowed to move toward the first wall 34 of the front rail 22. This arrangement may allow the tooth projection 64 to disengage with one of the teeth 40 and engage with another of the teeth 40, thus, increasing or decreasing a distance between adjacent side walls 122. This result may be accomplished by an operator moving the base member 24 along the front rail 22. That is, the front rail 22 may extend in a first direction and the base member 24 may extend in a second direction generally perpendicular to the first direction, and the tooth projection 64 may disengage one of the teeth 40 and engage with another of the teeth 40 by the base member 24 moving along the first direction.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A product pusher assembly comprising:

a front rail having a first wall and a second wall defining a channel, the first wall including a first surface facing the channel, the second wall including a second surface spaced from the first surface and facing away from the channel;

a base member having a third surface configured to engage the first surface, the base member defining a slot; and a pusher including a lower portion having a fourth surface configured to engage the second surface, wherein the slot is configured to slidably-receive an elongate member of the lower portion.

2. The product pusher assembly of claim 1, wherein engagement of the second surface and the fourth surface constrains rotation of the base member relative to the front rail.

3. The product pusher assembly of claim 1, wherein the base member is partially disposed in the channel.

4. The product pusher assembly of claim 3, wherein the front rail includes a ledge and a lip, the ledge having the first surface, the lip having the second surface.

5. The product pusher assembly of claim 4, wherein the base member includes a catch disposed in the channel and having the third surface.

6. The product pusher assembly of claim 4, wherein the lower portion is disposed outside of the channel.

7. The product pusher assembly of claim 1, further comprising a biasing member coupled to the base member and engaging the pusher, the biasing member biasing the pusher toward the front rail.

8. The product pusher assembly of claim 7, wherein the biasing member is a flat coil spring.

9. The product pusher assembly of claim 1, wherein the front rail includes a plurality of teeth and wherein the base member includes a tooth projection configured to engage the plurality of teeth.

10. A product pusher assembly comprising:

a front rail including a first wall and a second wall defining a channel, the first wall having a first surface facing the channel, the second wall including a second surface disposed outside of the channel;

a base member having a slot and a first catch, the first catch having a third surface configured to engage the first surface; and a pusher having a lower portion including an elongate member slidably-extending within the slot and including a second catch having a fourth surface configured to engage the second surface to inhibit rotation of the base member relative to the front rail.

11. The product pusher assembly of claim 10, wherein engagement of the second surface and the second catch prevents rotation of the base member relative to the front rail.

12. The product pusher assembly of claim 10, further comprising a biasing member coupled to the base member and engaging the pusher, the biasing member biasing the pusher toward the front rail.

13. The product pusher assembly of claim 12, wherein the biasing member is a flat coil spring.

14. The product pusher assembly of claim 12, wherein the biasing member includes an aperture and wherein the base member includes a stem disposed within the aperture of the biasing member.

15. The product pusher assembly of claim 10, wherein the channel extends in a first direction and wherein the pusher is slidable along a second direction substantially perpendicular to the first direction.

16. The product pusher assembly of claim 10, wherein the front rail includes a plurality of teeth and wherein the base member includes a tooth projection configured to engage the plurality of teeth.

* * * * *